United States Patent [19]

Marwick

[11] Patent Number: 4,812,248

[45] Date of Patent: Mar. 14, 1989

[54] LUBRICATING COMPOSITION AND METHOD

[75] Inventor: William F. Marwick, Byfield, England

[73] Assignee: Alcan International Limited, Montreal, Canada

[21] Appl. No.: 937,042

[22] Filed: Dec. 2, 1986

[30] Foreign Application Priority Data

Dec. 6, 1985 [GB] United Kingdom ..... 8530146

[51] Int. Cl.[4] ..... C10M 129/76

[52] U.S. Cl. ..... 252/56 R; 72/42

[58] Field of Search ..... 252/56 R; 260/410.6; 72/42

[56] References Cited

U.S. PATENT DOCUMENTS

| | | | |
|---|---|---|---|
| 2,126,128 | 8/1938 | Montgomery | 72/42 |
| 2,948,681 | 8/1960 | Milberger et al. | 72/42 |
| 3,468,701 | 9/1969 | Hughes | 117/134 |
| 3,526,596 | 9/1970 | Kress et al. | 252/49.5 |
| 4,113,635 | 9/1978 | Sakurai et al. | 252/49.6 |
| 4,175,047 | 11/1979 | Schick et al. | 252/565 |
| 4,191,658 | 3/1980 | Jahnke | 72/42 |
| 4,398,984 | 8/1983 | Uchiyama et al. | 72/42 |
| 4,445,813 | 5/1984 | Misra et al. | 72/42 |
| 4,578,202 | 3/1986 | Urban et al. | 72/42 |

FOREIGN PATENT DOCUMENTS

| | | | |
|---|---|---|---|
| 0127343 | 12/1984 | European Pat. Off. . | |
| 0192329 | 1/1986 | European Pat. Off. | 72/42 |
| 7900297 | 5/1979 | PCT Int'l Appl. . | |
| 8103293 | 11/1981 | PCT Int'l Appl. . | |

OTHER PUBLICATIONS

*The Condensed Chemical Dictionary,* Tenth Edition, Van Nostrand Reinhold Company Inc., N.Y., 1981, pp. 354, 450, and 503.

*Primary Examiner*—William R. Dixon, Jr.
*Assistant Examiner*—Jerry D. Johnson
*Attorney, Agent, or Firm*—Cooper & Dunham

[57] ABSTRACT

A lubricating composition for press forming consists of a lubricant dissolved or dispersed in a volatile liquid medium, wherein the lubricant comprises at least one ester of a polyhydric alcohol having two or three hydroxyl groups of which one or two are esterified with a long chain carboxylic acid and has a melting point above ambient temperature but low enough to permit removal from a metal surface by an aqueous alkaline cleaner.

The composition is useful for forming structures of shaped aluminium components on a production line.

6 Claims, No Drawings

LUBRICATING COMPOSITION AND METHOD

This invention relates to lubricating compositions, particularly those used for press-forming metal sheets. There is current interest in techniques for producing adhesively bonded structures of shaped aluminium components for use in the automotive industry. Such a technique is described for example in EPA No. 127343. The lubricants of this invention are suitable for use in such techniques. The technique of converting a coil of aluminium metal sheet into a structure of shaped components for use in the automotive industry may typically involve the following steps:

The metal surface is pre-treated to provide a strongly bonded layer thereon which acts as a base for subsequently applied adhesive.

A lubricant is applied to the treated metal coil. The coil may then be stored or transported, with the lubricant serving to protect the treated metal surface, and is cut up into pieces ready for press-forming.

The pieces of metal sheet are press-formed into components of desired shape. This and subsequent operations are all performed on an automobile production line.

Adhesive is applied to selected areas of the shaped components, without first removing the lubricant.

The components are assembled into the shape of the desired structure, and may be spot welded to give the structure green strength.

The adhesive is cured at elevated temperature.

The metal surfaces of the structure are subjected to an aqueous alkaline cleaner which removes the lubricant.

The structure is painted.

A lubricant for use in such a technique needs to fulfil several requirements:

(a) The lubricant must, obviously, have suitable lubricating properties for the press-forming operation.

(b) The lubricant should be solid at likely metal storage temperatures. A film of lubricant that is liquid or sticky is prone to smear and to pick up dust and dirt.

(c) Since it is not practicable in a production line to remove lubricant prior to application of adhesive, the lubricant needs to be compatible with the adhesive.

(d) After the adhesive has been applied and cured, the lubricant must be readily removable by an aqueous alkaline cleaner of the type conventionally used to prepare metal surfaces for painting.

There is a need for a lubricant which will fulfil all these requirements. It is an object of the pesent invention to fulfil that need. However, the lubricants of this invention are likely to be useful, not only for the technique described above, but also for other forming and shaping operations performed on a variety of metals.

In one aspect, the invention provides a lubricating composition for press forming consisting of a lubricant dissolved or dispersed in a volatile liquid medium, wherein the lubricant comprises at least one ester of a polyhydric alcohol having two or three hydroxyl groups of which one or two are esterified with a long chain carboxylic acid and has a melting point above ambient temperature but low enough to permit removal from a metal surface by an aqueous alkaline cleaner.

In another aspect, the invention provides a method of forming a metal sheet by the steps of applying to the metal sheet a lubricating composition as defined above, removing the volatile liquid medium, and subjecting the metal sheet to a forming operation.

In yet another aspect, the invention provides a method of forming a structure of shaped aluminium components comprising the steps of:

Applying to an aluminium sheet of lubricating composition as defined above and removing the volatile liquid medium, Press-forming pieces of the sheet into aluminium components, Applying adhesive to the components, Bringing the components together in the shape of the desired structure, And curing the adhesive.

The lubricant is an ester of a polyhydric alcohol with a long-chain carboxylic acid. Dihydric or trihydric alcohols are suitable, for example ethylene glycol, propylene glycol, diethylene glycol and glycerol. The long chain carboxylic acid is preferably a saturated straight-chain monocarboxylic acid having from 12 to 18 carbon atoms in the chain, such as lauric, palmitic or stearic acid. The ester may be a full ester, but partial esters containing one or more residual hydroxyl groups in the molecule may be advantageous as described below. Mixtures of esters may be used and may be advantageous. The lubricant may contain a minor proportion up to 50% of one or more other lubricating compounds, such as long-chain carboxylic acids, esters thereof with monohydric alcohols, long-chain alcohols and amide and hydrocarbon waxes.

Depending on its intended use, the lubricant may need to be compatible with subsequently applied adhesive. In general, the esters described herein are compatible as a result of being either absorbed or displaced by subsequently applied adhesive without grossly impairing the adhesive bond strength obtainable. By contrast, resinous lubricants and metal soap lubricants are generally not adhesive compatible in this sense. Furthermore, many conventional lubricants are used in the form of aqueous emulsions which contain surface active agents. These can cause problems on storage of lubricated sheet, or in respect of long term adhesion performance, and are preferably absent from compositions according to this invention.

The lubricant has a melting point above ambient temperature, preferably of at least 30° C. This ensures that the lubricant is present as a solid film on the metal substrate, which avoids problems with smearing and blocking during coiling, decoiling, slitting and cutting. The use of such a lubricant avoids contamination of the metal surface with a possibly adhesive-incompatible oil or contaminant and prevents local build up of lubricant to an undesirably thick layer.

The lubricant melts at a temperature low enough to permit its removal from a metal surface by an aqueous alkaline cleaner, such as is used in automotive production lines to prepare metal parts for painting. The highest practicable temperature for aqueous alkaline cleaners in such circumstances is about 70° C. Lubricants melting below 70° C. and preferably below 65° C. can thus always be removed by aqueous alkaline cleaners. Lubricants melting above 70° C. may or may not be removable depending on whether they have chemical groups, e.g. hydroxyl groups, which can react with the alkali to assist removal from the metal surface. Thus for example, a commercially available wax having a melting point of 85° C. and an acid number of 135 to 155 by DIN 53402, was found not to be removable by aqueous alkaline cleaners. On the other hand, glycerol monostearate, having a melting point of 81° C. and two free hydroxyl groups per molecule, is removable by aqueous alkaline cleaners, and falls accordingly within the scope of this invention. A lubricant is deemed removable by aqueous alkaline cleaners if it can be removed by treatment for 2 minutes at 70° C. with a 15% by weight aqueous solution of Ridoline 160 (a silicate-based proprietary cleaner marketed by I.C.I. plc).

It has been found in general that harder lubricants, give more effective performance in press-forming operations involving stretching. On the other hand, softer lubricants may have superior properties for forming operations involving drawing. In general, the presence of free hydroxyl groups in the molecule increases the hardness of a lubricant. Thus, ethylene glycol stearate, diethylene glycol stearate and glycerol stearate are all harder than cyclohexyl stearate, stearyl stearate and similar unhydroxylated esters. The presence of free hydroxyl groups in the lubricant ester thus achieves a double advantage; the lubricant performance, particularly in operations involving stretching, is improved; and removal from metal surfaces by aqueous alkaline cleaners is made easier. Preferred lubricants for use in this invention are thus hydroxylated esters of polyhydric alcohols with long chain carboxylic acids, and blends of such hydroxylated esters with full esters, the lubricants having melting points in the range 35° C. to 65° C. There follows a non-exhaustive list of esters suitable for use as lubricants according to this invention. Almost all these compounds are commercially available for soaps, cosmetics and other non-lubricant uses.

| | Melting Point |
|---|---|
| Glycerol mono-palmitate | 51–52° C. |
| Glycerol di-palmitate | 49–57° C. |
| Glycerol mono-laurate | 44° C. |
| Ethylene glycol mono-stearate | 56–60, 59–65, 65–66° C. (3 grades) |
| Ethylene glycol di-stearate | 58–62, 68–70° C. (2 grades) |
| Propylene glycol mono-stearate | 37–42, 33–34° C. (2 grades) |
| Propylene glycol di-stearate | approx. 52° C. |
| Diethylene glycol mono-stearate | 43–44° C. |
| Diethylene glycol di-stearate | 47–52° C. |
| Glycerol mono-stearate | 81° C.–74° C. |

The lubricant may be supplied in dispersion in an aqueous medium. More usually, it will be supplied in solution in a hydrocarbon such as xylene. After application of the liquid composition to the metal surface, the volatile liquid is removed by evaporation leaving a uniform thin film of the solid lubricant. The volatile liquid concentration is chosen to provide a convenient application viscosity. The rate of application to the metal surface will depend on the intended use, but may typically be in the range of 1 to 10 g/m$^2$ for aluminium coil to be formed into adhesively bonded structures.

EXAMPLE 1

Tests were performed to compare two of the lubricants with which this invention is concerned with four prior art lubricants, as follows:

Prior art lubricant A is a mineral oil.

Prior art lubricant B is cyclohexyl stearate.

Prior art lubricant C is a commercially available material containing chiefly lauryl laurate with a minor proportion of gylcerol monostearate, and is a semi-solid at ambient temperature.

Invention lubricant 1 is based on diethylene glycol monostearate.

Invention lubricant 2 is based on diethylene glycol distearate.

Both the invention lubricants are used in solution in xylene at a convenient application viscosity.

Prior art lubricant D contains ethylene bis-stearamide and lauric acid, and has a melting point of 135° C.

To perform the tests, sheets of 5251 alloy (Aluminum Association Inc. Register) of dimensions 26 cm×30 cm×0.875 mm were coated with the described press lubricants at various coat weights and pressed in a steel die to form a complex shape by a combination of bending, drawing and particularly stretching. Successful pressing resulted in a drawing-in of the sides of the blank, and the extent of drawing-in indicated the performance of the lubricant. Note was also taken of whether or not the pressing was split. Tests were performed in duplicate, and the results are set in out in the following table:

| Lubricant | Coatweight g/m$^2$ | Draw-in (mm) | Pressing Split (s) or not split (ns) |
|---|---|---|---|
| Prior Art A | 1.7 | 10.5 | s |
| | 1.7 | 11.0 | s |
| | 3.3 | 11.5 | s |
| | 3.3 | 11.5 | s |
| | 5.0 | 10.0 | s |
| | 5.0 | 11.0 | s |
| Prior Art B | 1.7 | 14.0 | s |
| | 1.7 | 15.0 | s |
| | 3.0 | 13.0 | s |
| | 3.0 | 13.0 | s |
| | 5.0 | 14.0 | s |
| | 5.0 | 11.0 | s |
| Prior Art C | 1.7 | 15.5 | s |
| | 1.7 | 15.5 | s |
| | 2.7 | 15.0 | s |
| | 2.7 | 15.0 | s |
| | 5.1 | 15.5 | s |
| | 5.1 | 15.5 | s |
| Invention 1 | 1.7 | 21.0 | ns |
| | 3.0 | 21.5 | ns |
| | 3.0 | 22.0 | ns |
| | 5.0 | 21.0 | ns |
| | 5.0 | 20.0 | ns |
| Invention 2 | 1.7 | 20.5 | ns |
| | 1.7 | 21.0 | ns |
| | 3.3 | 21.0 | ns |
| | 3.3 | 22.0 | ns |
| | 5.0 | 21.0 | ns |
| | 5.0 | 22.0 | ns |
| Prior Art D | 2.5 | 22.0 | ns |
| | 2.5 | 21.0 | ns |
| | 5.0 | 21.0 | ns |
| | 5.0 | 21.0 | ns |

The performance of prior art lubricants A, B and C was inferior. The extent of drawing-in of the sides of the blank was rather small and the pressings were all split. By comparsion, the performance of prior art lubricant D and of the two invention lubricants was superior. The sides of the blanks were in all cases drawn in to a substantial extent, and the pressings were not split. In addition, the invention lubricants 1 and 2 were easily removed from the pressings by an aqueous alkaline cleaner of the type normally used in automotive production lines prior to painting. By contrast, prior art lubricant D could not be removed by aqueous alkaline cleaner.

EXAMPLE 2

Adhesive compatibility was demonstrated by means of salt spray tests. Panels of 5251 alloy were given a 150 mg/m$^2$ chromate-based no-rinse pretreatment. Lubricant 1 (Example 1) was applied evenly at a lubricant rate of 2.8 g/m$^2$ to both surfaces. The panels were cut to give 100 mm×20 mm strips. A proprietary adhesive (Evode Ltd) was applied manually to one lubricated surface. Simple lap shear joints were formed with a 10×20 mm overlap and drilled by a standard procedure and were left in a salt-spray cabinet. Joint strengths were tested at intervals and were determined to be as follows:

0 weeks: 19.0 MPa;
4 weeks: 17.8 MPa;
8 weeks: 17.9 MPa.

These joint strengths are entirely satisfactory, and indicate that the lubricant is adhesive compatible.

I claim:

1. A lubricating composition for press forming consisting of a lubricant dissolved or dispersed in a volatile liquid medium, wherein the lubricant comprises at least one ester of a polyhydric alcohol having two or three hydroxyl groups of which one or two are esterified with a long chain carboxylic acid, wherein the lubricant includes at least one ester having a free hydroxyl group, said lubricant having a melting point above ambient temperature but low enough to permit removal from a metal surface by an aqueous alkaline cleaner.

2. A composition as claimed in claim 1, wherein the polyhydric alcohol is selected from glycerol, ethylene glycol, propylene glycol and diethylene glycol.

3. A composition as claimed in claim 1 wherein the carboxylic acid is a saturated straight-chain monocarboxylic acid having from 12 to 18 carbon atoms in the chain.

4. A composition as claimed in claim 1, wherein the lubricant has a melting point of from 35° C. to 65° C.

5. A composition as claimed in claim 1, wherein the lubricant is present in solution in a volatile hydrocarbon solvent.

6. A composition as claimed in claim 1, wherein the lubricant is compatible with heat-curable adhesive of the kind used in adhesively-bonded structures of aluminium components.

* * * * *